US008561337B2

(12) United States Patent
Lewis et al.

(10) Patent No.: US 8,561,337 B2
(45) Date of Patent: Oct. 22, 2013

(54) MONOLITHIC RAIL PLATFORM AND BOLT ASSEMBLIES FOR A FIREARM

(75) Inventors: Karl R. Lewis, Moline, IL (US); James Arend Seabold Bargren, Moline, IL (US); Jacob A. Schafer, Rock Island, IL (US); Neal David Hohl, Orion, IL (US)

(73) Assignee: Karl R. Lewis, Moline, IL (US)

( * ) Notice: Subject to any disclaimer, the term of this patent is extended or adjusted under 35 U.S.C. 154(b) by 123 days.

(21) Appl. No.: 12/872,065

(22) Filed: Aug. 31, 2010

(65) Prior Publication Data

US 2011/0005384 A1 Jan. 13, 2011

Related U.S. Application Data

(62) Division of application No. 10/513,254, filed as application No. PCT/US03/15009 on May 12, 2003, now Pat. No. 8,234,808.

(60) Provisional application No. 60/379,928, filed on May 10, 2002.

(51) Int. Cl.
*F41C 23/00* (2006.01)

(52) U.S. Cl.
USPC ..... 42/73

(58) Field of Classification Search
USPC ..... 42/73, 71.01, 72, 75.03, 75.01, 75.02; 89/191.01
See application file for complete search history.

(56) References Cited

U.S. PATENT DOCUMENTS

| | | | | |
|---|---|---|---|---|
| 2,094,156 | A | 9/1937 | Johnson, Jr. | |
| 2,146,743 | A | 2/1939 | Johnson, Jr. | |
| 2,341,869 | A | 2/1944 | Johnson, Jr. | |
| 2,383,487 | A | 8/1945 | Johnson, Jr. | |
| 2,386,802 | A | 10/1945 | Johnson, Jr. | |
| 2,400,422 | A | 5/1946 | Johnson, Jr. | |
| 2,409,568 | A | 10/1946 | Johnson, Jr. | |
| 2,409,569 | A | 10/1946 | Johnson, Jr. | |
| 2,437,137 | A * | 3/1948 | Swebilius | 42/75.02 |
| 2,481,548 | A | 9/1949 | Waltke, Jr. | |
| 2,484,444 | A | 10/1949 | Benson | |
| 2,950,653 | A | 8/1960 | Harvey | |
| 2,951,424 | A | 9/1960 | Stoner | |
| 3,075,314 | A | 1/1963 | Bakker | |

(Continued)

FOREIGN PATENT DOCUMENTS

| | | |
|---|---|---|
| DE | 93 04 489 U1 | 9/1993 |
| DE | 196 13 421 C2 | 7/2000 |

OTHER PUBLICATIONS

M-16 Rifle Fact File for the United States Army (http://www.army.mil/factfiles/equipment/individual/m16.html) Apr. 10, 2011.*

(Continued)

*Primary Examiner* — Michelle Clement
(74) *Attorney, Agent, or Firm* — Woodard, Emhardt, Moriarty, McNett & Henry LLP

(57) ABSTRACT

A firearm assembly for a firearm can include a monolithic rail platform with a handguard portion and an upper receiver portion. The barrel of the firearm can be positioned through the handguard portion and secured with the upper receiver portion. A firearm assembly can also include a bolt assembly with a bolt carrier having minimized land area and a forward end sized for receipt in the barrel extension at the rearward end of the barrel.

20 Claims, 8 Drawing Sheets

(56) References Cited

U.S. PATENT DOCUMENTS

| | | | | | |
|---|---|---|---|---|---|
| 3,090,150 | A | | 5/1963 | Stoner | |
| 3,198,076 | A | * | 8/1965 | Stoner | 89/128 |
| 3,380,183 | A | | 4/1968 | Miller et al. | |
| 3,507,187 | A | | 4/1970 | Maillard | |
| 3,690,218 | A | | 9/1972 | Maillard | |
| 3,731,418 | A | | 5/1973 | Birkenhagen et al. | |
| 3,742,638 | A | | 7/1973 | Archer | |
| 3,834,053 | A | * | 9/1974 | Bielfeldt et al. | 42/75.02 |
| 3,883,977 | A | * | 5/1975 | McClure | 42/75.02 |
| 3,939,589 | A | * | 2/1976 | Tellie | 42/71.01 |
| 3,979,849 | A | | 9/1976 | Haskins | |
| 4,058,922 | A | | 11/1977 | Elbe et al. | |
| 4,272,902 | A | | 6/1981 | Waters | |
| 4,398,448 | A | | 8/1983 | LaFever | |
| 4,433,610 | A | | 2/1984 | Tatro | |
| 4,536,982 | A | | 8/1985 | Bredbury et al. | |
| 4,579,034 | A | | 4/1986 | Holloway | |
| 4,653,210 | A | | 3/1987 | Poff, Jr. | |
| 4,655,118 | A | | 4/1987 | Bruderer et al. | |
| 4,663,875 | A | | 5/1987 | Tatro | |
| 4,729,186 | A | * | 3/1988 | Rieger | 42/75.04 |
| 4,765,224 | A | | 8/1988 | Morris | |
| 4,769,938 | A | * | 9/1988 | Chesnut et al. | 42/76.02 |
| 4,891,898 | A | | 1/1990 | Houseman | |
| 4,942,802 | A | | 7/1990 | Stoner | |
| 4,944,109 | A | | 7/1990 | Zedrosser | |
| 5,010,676 | A | | 4/1991 | Kennedy | |
| 5,142,806 | A | * | 9/1992 | Swan | 42/114 |
| 5,155,284 | A | * | 10/1992 | Flashkes | 42/75.02 |
| 5,198,600 | A | | 3/1993 | E'Nama | |
| 5,343,650 | A | | 9/1994 | Swan | |
| 5,351,598 | A | | 10/1994 | Schuetz | |
| 5,448,940 | A | * | 9/1995 | Schuetz et al. | 89/185 |
| 5,513,461 | A | | 5/1996 | Weldle | |
| 5,540,008 | A | * | 7/1996 | Kirnstatter | 42/75.02 |
| 5,551,179 | A | | 9/1996 | Young | |
| 5,590,484 | A | | 1/1997 | Mooney et al. | |
| 5,689,908 | A | | 11/1997 | Brandl | |
| 5,726,375 | A | | 3/1998 | Adams et al. | |
| 5,826,363 | A | | 10/1998 | Olson | |
| 5,881,486 | A | * | 3/1999 | Bilgeri et al. | 42/75.02 |
| 5,900,577 | A | | 5/1999 | Robinson et al. | |
| 5,911,173 | A | | 6/1999 | Westrom | |
| 5,974,716 | A | | 11/1999 | Kidd | |
| 6,044,748 | A | | 4/2000 | Westrom | |
| 6,182,389 | B1 | | 2/2001 | Lewis | |
| 6,250,194 | B1 | | 6/2001 | Brandl et al. | |
| 6,490,822 | B1 | | 12/2002 | Swan | |
| 6,499,246 | B1 | | 12/2002 | Zedrosser | |
| 6,671,990 | B1 | | 1/2004 | Booth | |
| 6,694,660 | B1 | * | 2/2004 | Davies | 42/75.01 |
| 6,722,255 | B2 | * | 4/2004 | Herring | 89/193 |
| 6,752,137 | B2 | * | 6/2004 | Brunette et al. | 124/74 |
| 6,848,351 | B1 | | 2/2005 | Davies | |
| 7,000,345 | B1 | * | 2/2006 | Kay | 42/75.02 |
| 7,059,076 | B2 | * | 6/2006 | Stoner et al. | 42/75.01 |
| 7,131,228 | B2 | * | 11/2006 | Hochstrate et al. | 42/75.01 |
| RE39,465 | E | | 1/2007 | Swan | |
| 7,581,954 | B2 | * | 9/2009 | Schavone | 434/18 |
| 7,810,271 | B2 | * | 10/2010 | Patel | 42/75.03 |
| 7,827,722 | B1 | * | 11/2010 | Davies | 42/75.02 |
| 2006/0065112 | A1 | * | 3/2006 | Kuczynko et al. | 89/193 |
| 2008/0216375 | A1 | * | 9/2008 | Barrett | 42/16 |
| 2009/0288324 | A1 | * | 11/2009 | Peterson et al. | 42/75.03 |
| 2010/0212201 | A1 | * | 8/2010 | Kincel et al. | 42/2 |
| 2010/0229445 | A1 | * | 9/2010 | Patel | 42/6 |

OTHER PUBLICATIONS

Colt Weapon Systems (http://www.colt.com/milM16.asp) Apr. 10, 2011.*

M16—definition of M16 (http://www.thefreedictionary.com/M16) Apr. 10, 2011.*

Wikipedia, M16 rifle (http://en.wikipedia.org/wiki/M16_rifle) Apr. 10, 2011.*

Glossary of Ordnance Terms, Walker Editor, 1959, p. 236.*

Illustrated Firearms Dictionary, Hallowell, Morris.*

C-More Systems, Quad Rail Handguard, Printed Publication—Dated Sep. 3, 2001.

Statement of New Questions of Patentability—Filed Dec. 1, 2006 for U.S. Patent No. 6,694,660 assigned U.S. Appl. No. 90/006,357.

Armalite, Inc.—Technical Note 9: Installation of Armalite Fiberglass Handguard, Printed publication dated Aug. 28, 1997.

Patrick A. Rogers, The Monolithic Rail Platform Carbine, SWAT Magazine, Oct./Nov. 2004 at 4 and 52-57.

Ben Battles, AR Report: Lewis Machine & Tool Monolithic Rail Platform, Shedding New Light on the "Black Rifle," on Target Sep. 2005 at 20-21.

Gary Paul Johnston, The Monolithic Rail Platform: Finally a Quick-Change Barrel System for the M16!, Soldier of Fortune Magazine, Sep. 2004 at 48-57.

International Search Report for PCT/US2003/15009.

Auto Trans of DE19613421 from ESPANET.

* cited by examiner

MONOLITHIC RAIL PLATFORM AND BOLT ASSEMBLIES FOR A FIREARM

This application is a divisional of U.S. application Ser. No. 10/513,254, filed Aug. 11, 2005 now U.S. Pat. No. 8,234,808, which is the national stage of International Application No. PCT/US03/15009, filed May 12, 2003, which claims the benefit of U.S. Provisional Application No. 60/379,928, filed May 10, 2002, which are all hereby incorporated by reference.

BACKGROUND

The use of automatic and semi-automatic rifles is commonly known to be prevalent in the military. Such weapons typically employ an upper receiver and bolt action operating system. One standard weapon for the U.S. Military is the M-16 rifle. Semi-automatic rifles such as the AR15 type are used in the civilian sector. Such rifles can be further adapted for single shot action. The structure and mechanisms of semi-automatic and automatic rifles have been the subject of much refinement and variation over the years.

While there have been advances in the designs of prior art rifles, there remains room for additional improvements. The present invention is directed toward providing various improvements to semi-automatic and automatic rifles.

SUMMARY

The present invention is directed to monolithic rail plate platforms and bolt assemblies for rifles.

According to one aspect, there is provided a monolithic rail platform that includes a handguard portion and an upper receiver portion integrally formed with one another as a single component.

According to another aspect, there is provided an improved bolt carrier for a semi-automatic or automatic rifle.

According to a further aspect, there is provided an improved operating system for a semi-automatic or automatic rifle.

According to yet another aspect, there is provided an improved rifle assembly for attachment of peripheral components thereto.

These and other aspects will also be apparent from the following description of the illustrated embodiments.

DESCRIPTION OF THE ILLUSTRATED EMBODIMENTS

Figure 1:
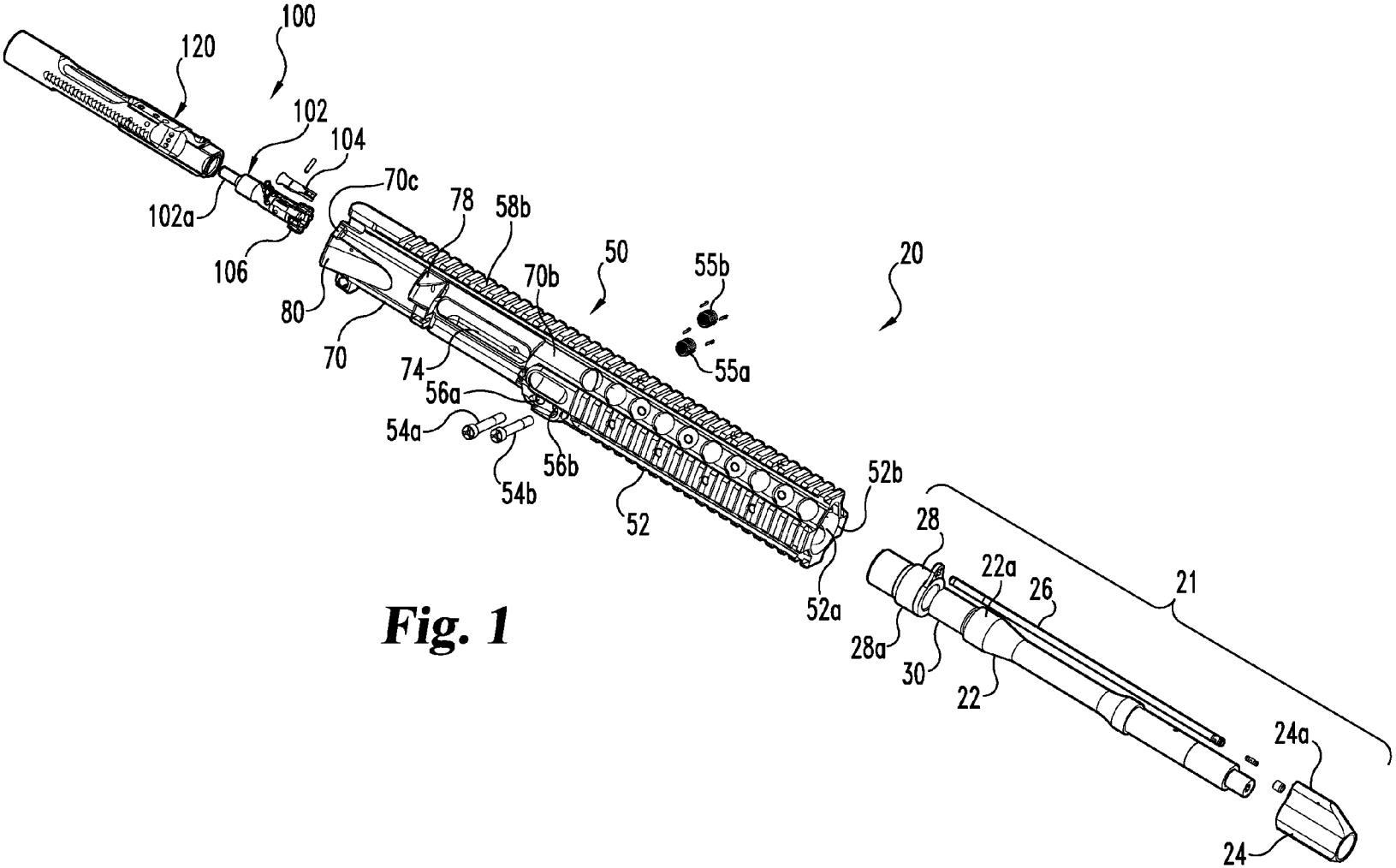
FIG. 1 is an exploded view of an upper portion of a firearm.
Figure 2:
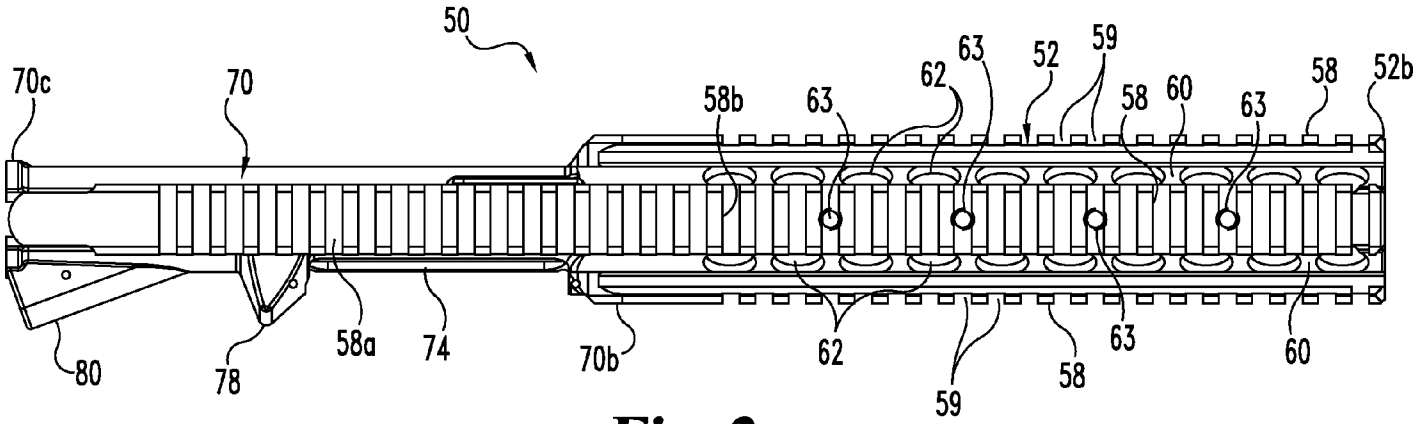
FIG. 2 is a top view of an monolithic rail platform comprising the upper portion of FIG. 1.
Figure 3:
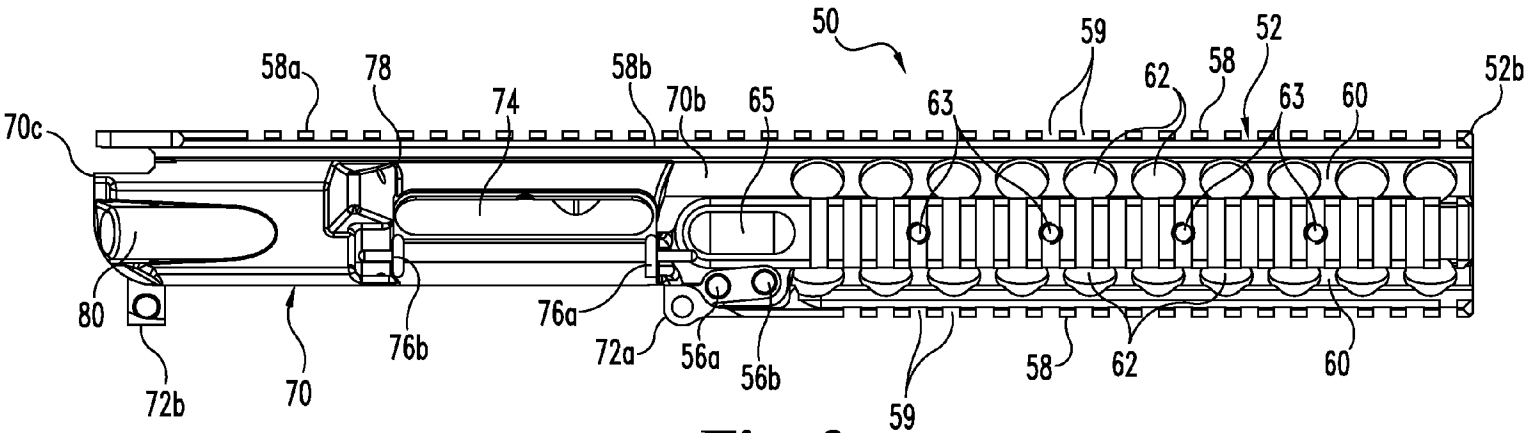
FIG. 3 is a side view of the monolithic rail platform of FIG. 2.
Figure 4:
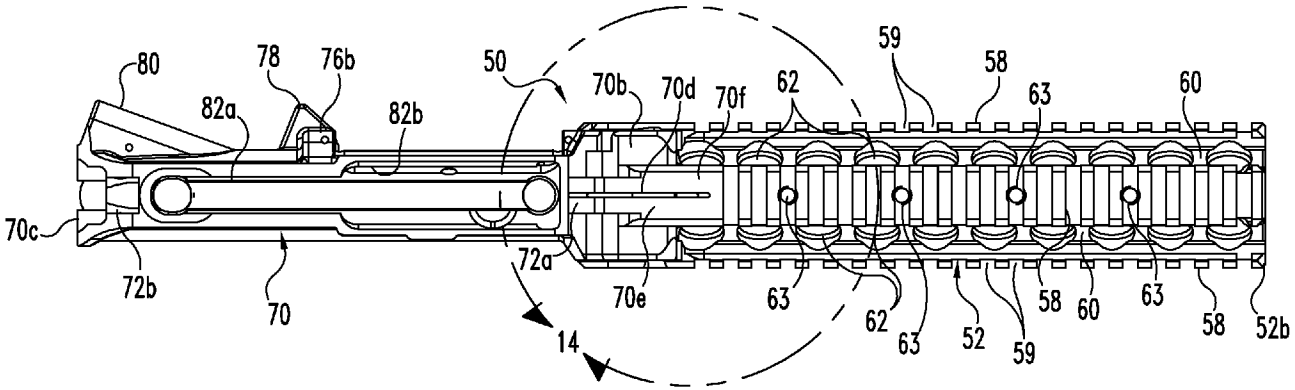
FIG. 4 is a bottom view of the monolithic rail platform of FIG. 2.
Figure 5:
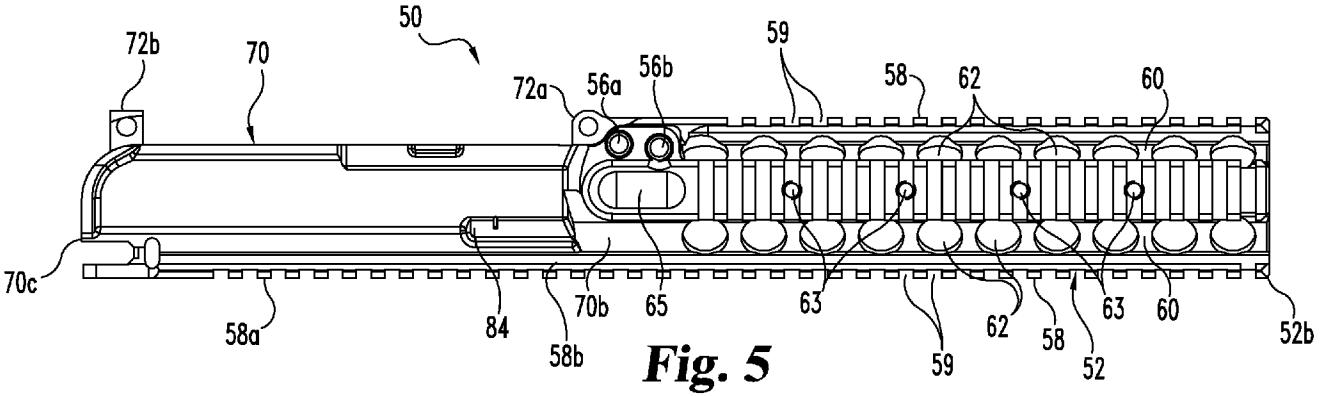
FIG. 5 is an inverted side view of the monolithic rail platform of FIG. 2 looking at the side opposite the side shown in FIG. 3.
Figure 7:
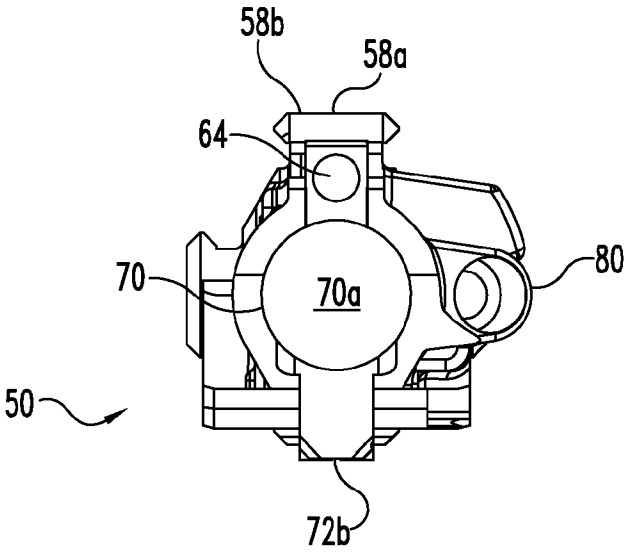
FIG. 7 is a left end view of the monolithic rail platform of FIG. 2.
Figure 6:
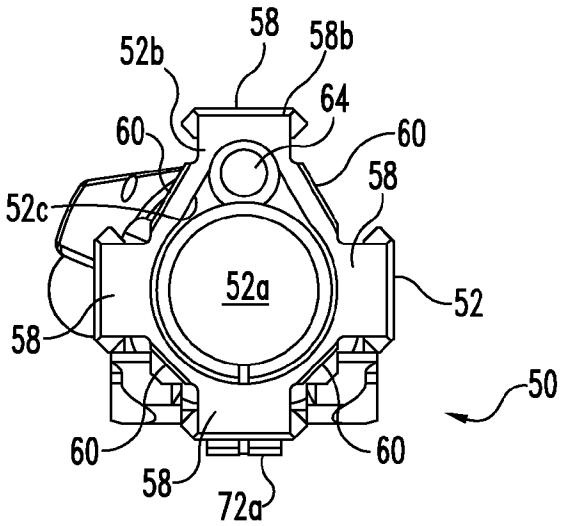
FIG. 6 is a right end view of the monolithic rail platform of FIG. 2.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated herein are contemplated as would normally occur to one skilled in the art to which the invention relates.

An assembly 20 for an upper portion of a firearm is shown in FIG. 1 in an exploded view. The lower receiver assembly, butt stock and magazine are not shown in FIG. 1, it being understood that the lower receiver, butt stock and magazine can be provided in any configuration suitable for an automatic M16/AR15 type rifle or other type or caliber semi-automatic or automatic rifle. Assembly 20 includes a barrel assembly 21 that includes a barrel 22 having a gas block 24 attachable to a forward end thereof. A gas tube 26 extends rearwardly from gas block 24 to the weapon operating system. A barrel extension 28 is attachable to the rearward end of barrel 22 adjacent cartridge chamber 30. Barrel extension 28 is configured to interlock with the bolt, such as bolt 102. Further details regarding one embodiment bolt 102 and barrel extension 28 are provided in U.S. Pat. No. 6,182,389, which is incorporated herein by reference in its entirety. Assembly 20 further includes an monolithic rail platform 50 that includes a handguard portion 52 integrally formed with an upper receiver portion 70.

Figure 14:
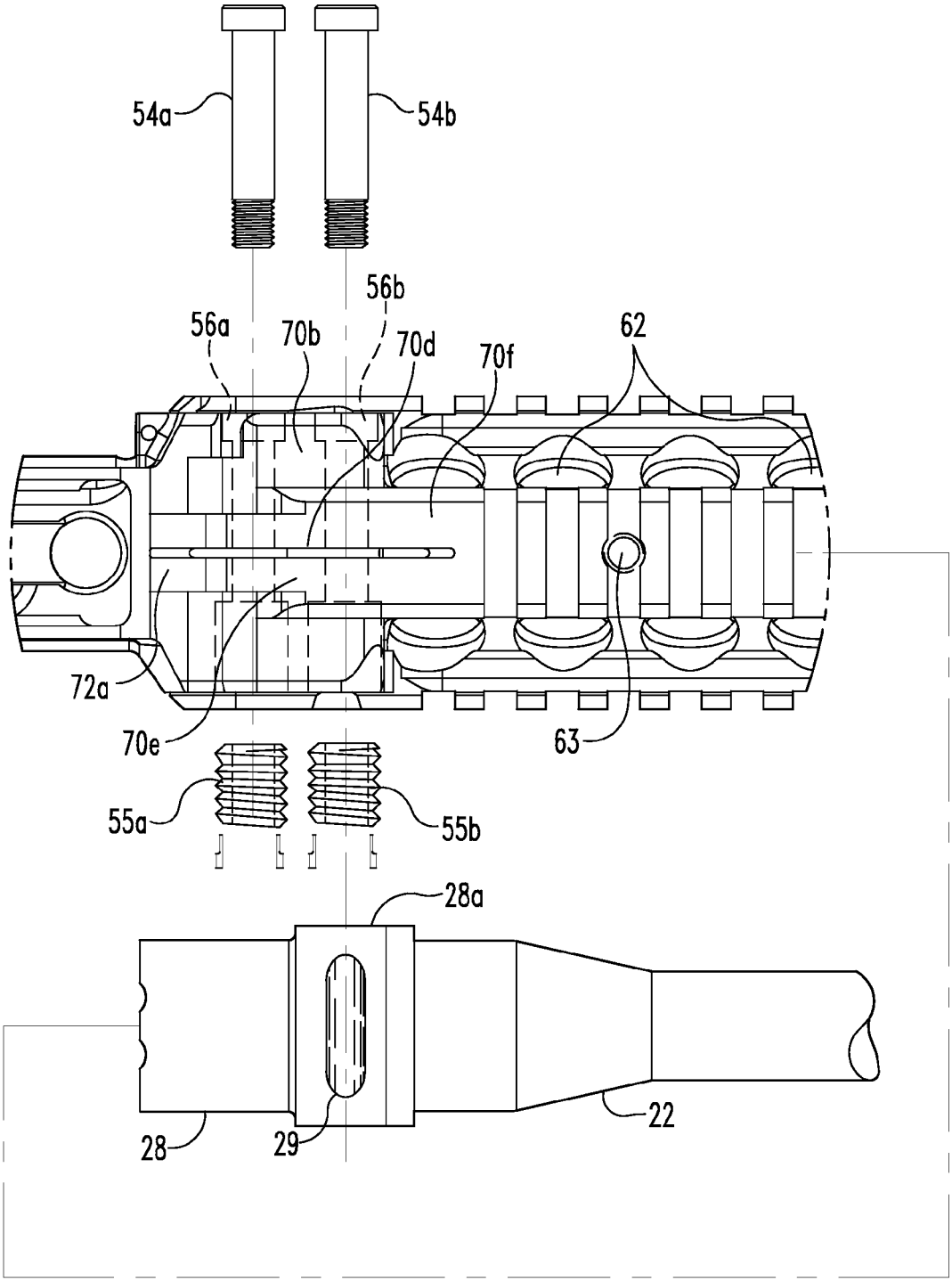
FIG. 14 is a bottom view of section 14 of the monolithic rail platform of FIG. 2 shown in a partial assembly view with barrel assembly 21 of FIG. 1.

Referring now further to FIGS. 2-7 and 14, when assembly 20 is assembled, a bolt carrier 120 housing bolt 102 is positioned in and movably received along the longitudinal axis of bore 70*a* of upper receiver portion 70, and barrel assembly 21 is positioned in bore 52*a* of handguard portion 52. Barrel assembly 21 is secured to monolithic rail platform 50 with fasteners 54*a*, 54*b* and clamping nuts 55*a*, 55*b*. Fasteners 54*a*, 54*b* extend through respective ones of the holes 56*a*, 56*b* through monolithic rail platform 50. Clamping nuts 55*a*, 55*b* are coupled to the threaded ends of fasteners 54*a*, 54*b* to clamp monolithic rail platform 50 around enlarged portion 28*a* of barrel extension 28 on_barrel 22 at the forward end of upper receiver portion 70. It is further contemplated that fastener 54*b* can act as a locating and retaining pin by interacting with enlarged portion 28*a* of barrel extension 28 to ensure that barrel 22 is properly positioned and located in monolithic rail platform 50. For example, fastener 54*b* can be received in a recess 29 formed in an outer surface of enlarged portion 28*a* of barrel extension 28 when barrel 22 is at the proper locating in bore 52*a* of handguard portion 52 as depicted in FIG. 14. Fastener 54*b* in recess 29 can resist any forward movement of barrel 22 and barrel extension 28 that might be created by contact of the bolt carrier therewith.

Handguard portion 52 includes a number of rails 58 extending therealong separated by recesses 60 therebetween including upper rail 58*b*. Rails 58 and upper rail 58*b* include transverse grooves 59 formed therein to facilitate gripping of handguard portion 52. A number of threaded holes 63 are spaced along each rail 58 to allow attachment of peripheral devices, such as a grenade launcher, site, sling and/or scope, for example. Recesses 60 each include a number of holes 62 formed therein along handguard portion 52 to allow air flow and heat from barrel 22 to vent therethrough.

Handguard portion 52 further includes a rearward extension 58*a* for the upper rail 58*b* that extends along upper receiver portion 70. As illustrated in FIGS. 1-3 and 5, upper rail 58*b* is contiguous and extends along upper receiver portion 79 and handguard portion 70. The rearward extension 58*a* includes a passage 64 formed therethrough that communicates gas tube 26 to provide a path for delivering gas to the operating system of the rifle. The forward end 52*b* of handguard portion 52 includes a triangular shaped opening 52*c* adapted to receive the upper extension 24*a* of gas block 24. Gas tube 26 is coupled to upper extension 24*a* of gas block 24.

Upper receiver portion 70 includes a forward end 70*b* integrally formed with handguard portion 52 and a rearward end 70*c*. Forward end 70*b* can comprise a clamping portion having clamping members 70*e*, 70*f* positioned on opposite sides of slot 70*d* to facilitate clamping of upper receiver portion 70 about barrel 22. A cut-out 65 is formed in forward end 70*b* to reduce weight. Upper receiver portion 70 further includes a forward lug 72*a* and a rearward lug 72*b* extending downwardly from a bottom side thereof. The lower receiver assembly (not shown) is attachable to lugs 72*a*, 72*b*. Upper receiver portion 70 further includes ejection port opening 74 and ejection port cover receptacles 76*a*, 76*b* on opposite sides thereof. Ejection port receptacles 76*a*, 76*b* receive pins that pivotally couple an ejection port cover (not shown) over opening 74. A deflector 78 extends outwardly from upper receiver portion 70 adjacent the rearward end of ejection portion opening 74 to deflect ejected cartridges away from the shooter. Upper receiver portion 70 further includes a forward assist port 80 that receives a forward assist mechanism (not shown) to assist in positioning the bolt carrier assembly 100 in its forward battery position in upper receiver portion 70 if needed.

Opposite ejection port receptacle 74 there is a lip of material 84 to support a cam pin cut-out in the upper receiver portion 70. Upper receiver portion 70 further includes in the bottom side thereof a first opening 82*a* along a rearward portion thereof for receiving the trigger assembly of the lower receiver assembly. Upper receiver portion 70 also includes a second opening 82*b* along a forward portion thereof communicating with the magazine receptacle of the lower receiver assembly for receiving cartridges therethrough from the magazine of the rifle. Second opening 82*b* is wider than first opening 82*a* and first and second openings 82*a*, 82*b* are in communication with one another along the bottom portion of upper receiver portion 70. The rearward end 70*c* of upper receiver portion 70 is positionable adjacent the lower receiver extension assembly and buttstock assembly of the lower receiver assembly when the rifle is assembled.

With barrel 22 secured to the coupling portion at forward end 70*b* of upper receiver portion 70, handguard portion 52 can extend around barrel 22 with upper rail 58*b* extending over barrel 22, but handguard portion 52 or rails 58, including upper rail 58*b*, need not be supported by, or in contact with, or coupled to barrel 22. Accordingly, barrel 22 can float in bore 52*a* of handguard portion 52. Monolithic rail platform 50 allows the hoop strength of handguard portion 52 to be maximized since, in one embodiment, it is provided as a single continuous ring extending along barrel 22. The integral unitary construction of upper receiver portion 70 and handguard portion 52 provide a stronger, reliable rifle assembly since there are fewer parts that require assembly. Peripheral devices, such as scope mounts, sites, slings, and grenade launchers, for example, that are mounted on handguard portion 52 do not apply load on or influence barrel 22, improving rifle accuracy. Rather, such loads and other influences created by these peripherals are transmitted from handguard portion 52 to upper receiver portion 70. Furthermore, in one embodiment, any threaded connection between barrel 22 and upper receiver portion 70 is eliminated, allowing rapid attachment and detachment of barrel 22 via fasteners 54*a*, 54*b*. The integral upper receiver and handguard portions and means of attaching the barrel allow for rapid assembly and disassembly of rifle components, which can be critical in the field. The integral construction of monolithic rail platform 50 also permits barrel 22 to be inserted and removed from upper receiver portion 70 while handguard portion 52, rails 58 and upper rail 58*b* remain integrally formed with upper receiver portion 70.

Referring now to FIGS. 8-13, further details regarding bolt carrier 120 of bolt assembly 100 will be provided. Bolt carrier 120 includes a forward end 120*a* and an opposite rearward end 120*b*. Forward end 120*a* is oriented toward barrel 22 when bolt carrier 120 is positioned in upper receiver portion 70. A passage 120*d* extends between forward end 120*a* and rearward end 120*b* along a longitudinal axis of bolt carrier 120. Passage 120*d* has a minimum diameter portion 120*c* sized to receive the reduced diameter end portion 102*a* of bolt 102 when positioned therein. Passage 120*d* further includes a bolt receiving portion 120*e* extending forwardly from minimum diameter portion 120*c* to forward end 120*a* to receive the remaining portion of bolt 102. Bolt 102 is mounted in bolt carrier 120 for axial sliding movement in forward portion 120*e*. Bolt 102 includes a cartridge extractor 104 pivotally coupled thereto, and includes lugs 106 at the forward end thereof that releasably interlock with barrel extension 28. A firing pin (not shown) extends through a central bore through bolt 102. A cam slot 124 is formed adjacent forward end 120*a* which receives a cam member therethrough for contacting bolt 102 to rotate it as it moves rearwardly and forwardly for engagement with barrel extension 28.

Figure 8:
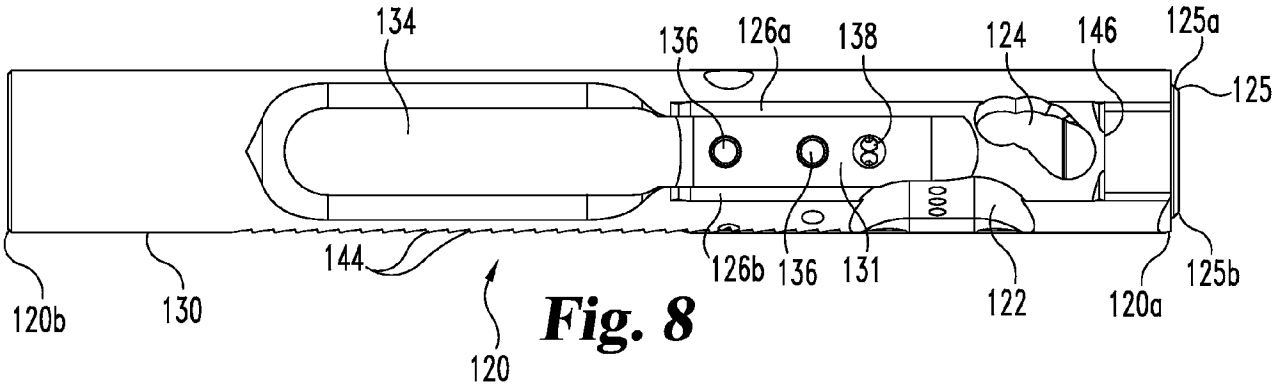
FIG. 8 is a top view of a bolt carrier comprising a portion of the upper portion of FIG. 1.
Figure 9:
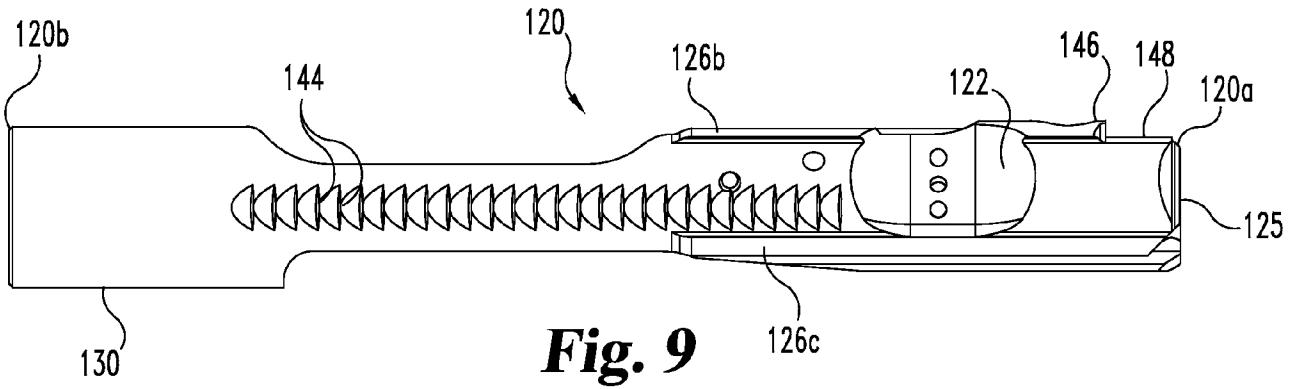
FIG. 9 is a side view of the bolt carrier of FIG. 8.
Figure 10:
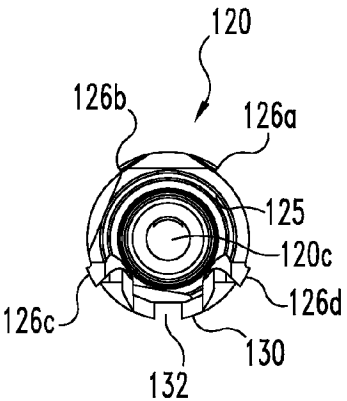
FIG. 10 is a right end view of the bolt carrier of FIG. 8.
Figure 11:
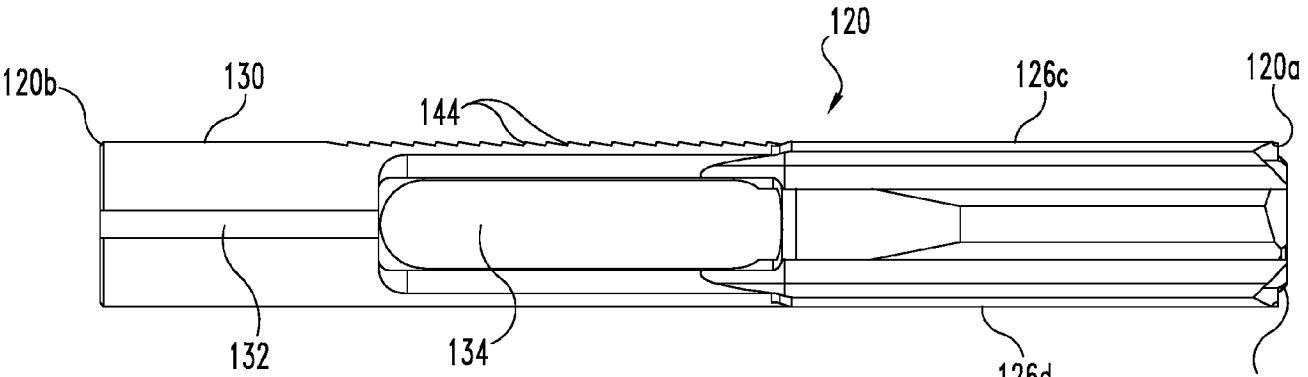
FIG. 11 is a bottom view of the bolt carrier of FIG. 8.
Figure 13:
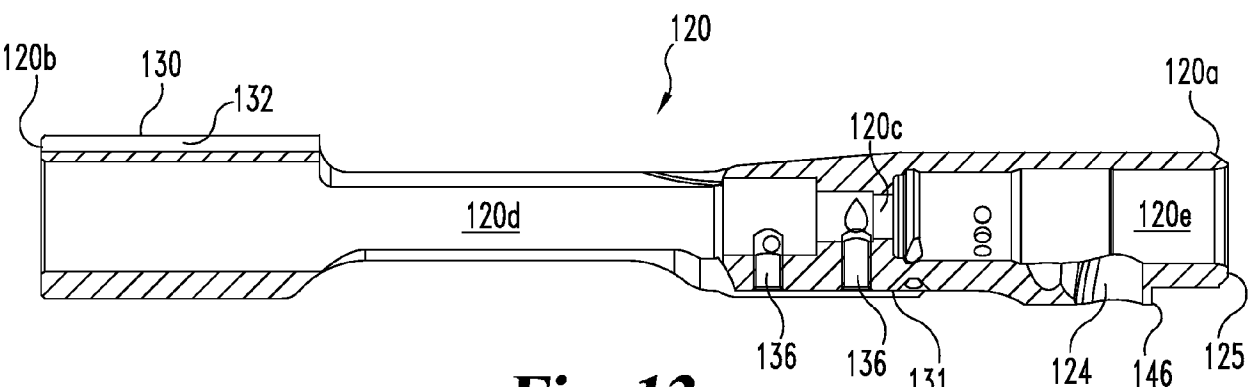
FIG. 13 is a section view through line 13-13 of FIG. 12.
Figure 12:
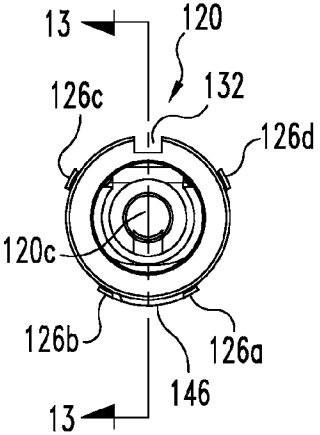
FIG. 12 is a left end view of the bolt carrier of FIG. 8 as oriented in FIG. 11.
Figures 15, 16:
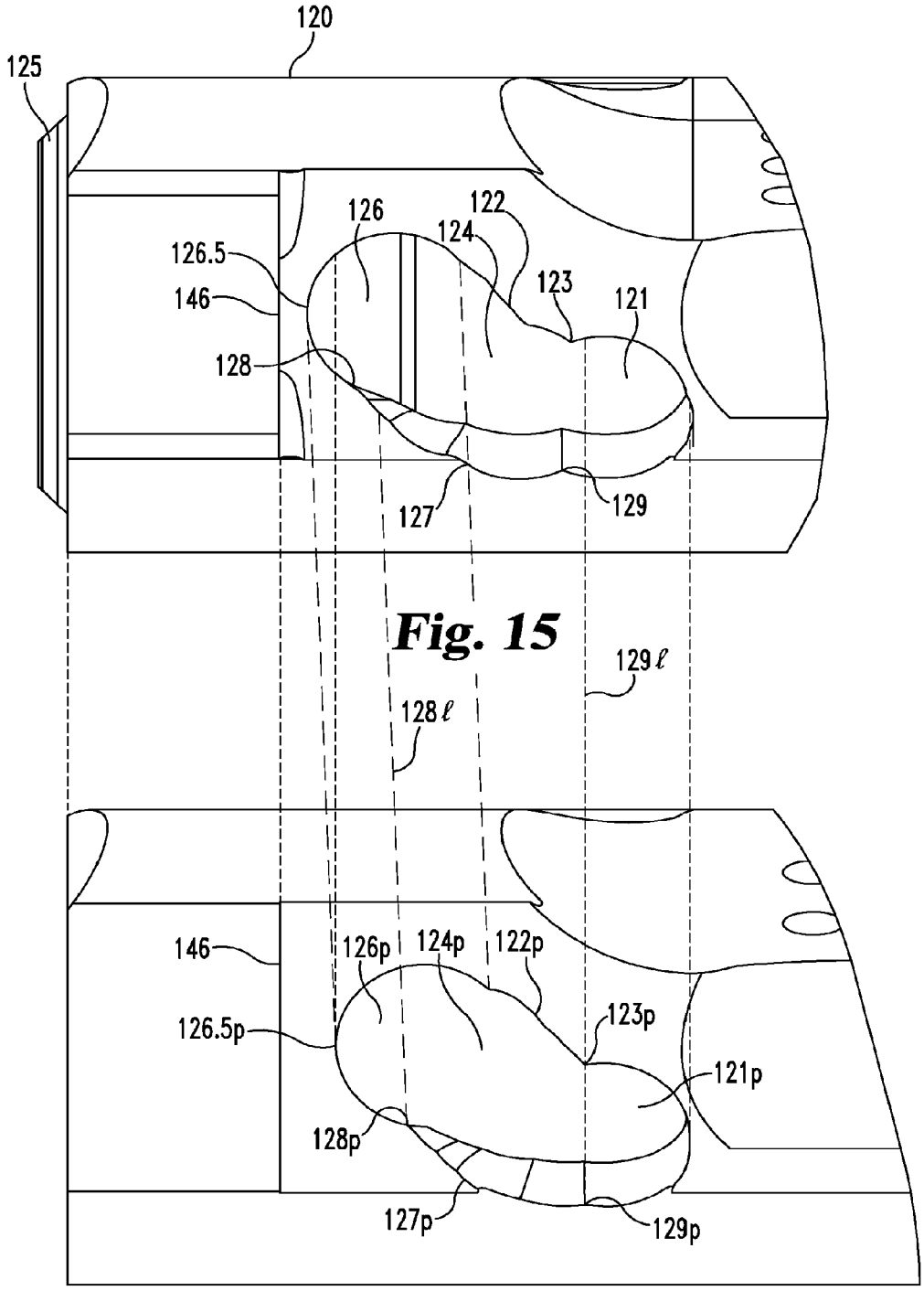
Fig. 16 (PRIOR ART)
FIG. 15 is a close up view of the front end of bolt carrier 120 shown in FIG. 8.
FIG. 16 is a close up view of the front end of a prior art M-16 bolt carrier.

Referring now to FIG. 15, a close up view of the front end of bolt carrier 120 illustrated in FIG. 8 is shown illustrating cam slot 124. Cam slot 124 includes locked position 121, unlocked position 126, forward edge 126.5, unlocking cam path 127, delay ridge 128, end of unlock dwell 129, locking cam path 122 and delay ridge 123. Locked position 121 is the approximate position of the cam member when bolt 102 is locked in engagement with barrel extension 28. Unlocked position 126 is the approximate position of the cam member during extraction and reloading when bolt 102 is unlocked from barrel extension 28. Unlocking cam path 127 is the surface that the cam member slides across as bolt carrier 120 moves rearwardly with respect to bolt 102 thereby unlocking bolt 102 from barrel extension 28. Delay ridge 128 provides a small hitch in unlocking cam path 127 prior to the cam member reaching unlocked position 126. End of unlock dwell 129 is the end of strictly longitudinal movement of the cam member and bolt 102, afterwards rotation to unlock bolt 102 from barrel extension 28 begins. Locking cam path 122 is the surface that the cam member slides across as bolt carrier 120 moves forwardly with respect to bolt 102 while bolt 102 engages with and locks into barrel extension 28. Delay ridge 123 provides a small hitch in locking cam path prior to the cam member reaching locked position 121.

Referring now to FIG. 16, a close up view of the front end of a prior art M-16 bolt carrier is illustrated in the same scale as and aligned with FIG. 15. FIG. 16 illustrates prior art cam slot 124*p* which includes locked position 121*p*, unlocked position 126*p*, forward edge 126.5*p*, unlocking cam path 127*p*, delay ridge 128*p*, end of unlock dwell 129*p*, locking cam path 122*p* and delay ridge 123*p*, each of which, while differently shaped, perform the same functions described above with regard to comparable features of cam slot 124. Also shown are lines 128λ and 129λ between cam slot 124*p* and cam slot 124. Line 128λ originates at delay ridge 128*p* and extends up toward FIG. 15 at an angle equal to a line between forward edge 126.5 and forward edge 126.5*p*. Line 129λ extends up from end of unlock dwell 129*p*.

Comparing cam slot 124 with cam slot 124*p*, note that forward edge 126.5 is closer to charging handle contact portion 146 than forward edge 126.5*p* by approximately the depth of protrusion 125 (approximately 0.100"). Similarly, end of unlock dwell 129 is positioned more forward than end of unlock dwell 129*p* by approximately the depth of protrusion 125. This provides the previously discussed increase in the dwell time of bolt 102 prior to extraction which allows more time to vent residual gas pressure in barrel 22 prior to unlocking bolt 102 from barrel extension 28. Finally, delay ridge 128 is substantially removed from cam slot 124 as it is substantially less prominent and more forward compared to delay ridge 128*p*.

Bolt carrier 120 includes a slot 134 therethrough that receives the hammer from the lower receiver assembly to strike the firing pin in bolt 102. Bolt carrier 120 further includes gas key mounting holes 136 formed in an upper mounting surface 131 of bolt carrier 120. Gas key mounting holes 136 communicate with passage 120*d*. A gas port 138 is further provided in mounting surface 131 and includes ports extending therefrom in communication with passage 120*d*. One side of bolt carrier 120 is provided with forward assist notches 144 which are engageable by a forward assist mechanism (not shown) in forward assist port 80 of upper receiver portion 70. Bolt carrier 120 further includes a door opener 122 that is recessed in the body of bolt carrier 120 to provide room for the door latch to close. Bolt carrier 120 includes a charging handle contact portion 146 adjacent forward end 120*a*.

Rearward end portion 130 includes a groove 132 cut therein along the longitudinal axis of bolt carrier 120 to maintain alignment of bolt carrier 120 as it axially reciprocates in upper receiver portion 70. Bolt carrier 120 further includes forward lands 126*a*, 126*b*, 126*c*, and 126*d* extending along the forward half of bolt carrier 120. Lands 126*a*, 126*b* extend along the upper portion of bolt carrier 120 along mounting surface 131 and terminate at contact portion 146. Lands 126*c* and 126*d* extend along the bottom portion of bolt carrier 120 and terminate at forward end 120*a*. The lands 126*a*, 126*b* 126*c*, 126*d* contact the inner wall of bore 70*a* of upper receiver portion 70 to maintain alignment of bolt carrier 120 centrally therein and also in alignment with the centerline of barrel 22. The land area along bolt carrier 120 and also along forward end portion 148 is minimized by reducing the land area in the range from one-half to one twenty-fifth of that of prior art bolt carriers.

The portion of bolt carrier 120 along which each of the lands 126*a*, 126*b*, 126*c*, 126*d* extends has a surface area, and lands 126*a*, 126*b*, 126*c*, 126*d* occupy a portion of that surface area. In one embodiment, a section of bolt carrier 120 including lands 126*a*, 126*b*, 126*c*, 126*d* occupies a surface area that ranges from 1% to 12% of the surface area of the occupied portion of the bolt carrier 120. In another embodiment, lands 126*a*, 126*b*, 126*c*, 126*d* occupy a surface area that ranges from 1% to 8% of the surface area of the occupied portion of the bolt carrier. In another embodiment, lands 126*a*, 126*b*, 126*c*, 126*d* occupy a surface area that ranges from 1% to 4% of the surface area of the occupied portion of the bolt carrier.

By minimizing the land area, the contact surface area between bolt 120 and the wall of bore 70*a* of upper receiver portion 70. This allows greater ease of movement of bolt carrier 120 in upper receiver portion 70. The reduced contact area also provides greater clearance between bolt carrier 120 and any particles in bore 70*a* of upper receiver portion 70, allowing bolt carrier 120 to deposit such particles and debris in the recessed areas between the lands to provide a self-cleaning action that reduces malfunction in harsh environments and with prolonged usage.

The protrusion 125 at the forward end of bolt carrier 120 is sized for receipt in the rearwardly facing opening of barrel extension 28. Protrusion 125 is positioned radially inwardly from the outer perimeter of forward end 120*a*, and includes a sloped or chamfered outer surface that extends from a first diameter at rearward end 125*b* adjacent forward end 120*a* to a reduced diameter forward face 125*b* at the forward end of protrusion 125. Bore 120*d* extends through protrusion 125. Protrusion 125 allows bolt carrier 120 to be positioned more forwardly in upper receiver portion 70 as compared to a bolt carrier having the same overall length without protrusion 125. By positioning bolt carrier 120 more forwardly in upper receiver portion 70, the time required to move bolt carrier 120 rearwardly to turn bolt 102 is increased. Protrusion 125 thus increases the stroke length for bolt carrier 120 in upper receiver portion 70. The additional stroke length provided by protrusion 125 increases the dwell time of bolt 102 in barrel extension 28, allowing residual gas pressure in barrel 22 more time to vent before bolt 102 unlocks with barrel extension 28.

In one embodiment, protrusion 125 is sized to extend forwardly a distance of one hundred thousandths of an inch to increase the dwell time of bolt 102 by up to two times that provided in bolt carriers without protrusion 125. It is contemplated that other embodiments may provide other lengths and/or other dwell times associated with protrusion 125. The reduced gas pressure in the blowback operation reduces the load exerted on extractor 104 during the extraction cycle, improving system operation in the extraction and ejection cycles for the spent cartridge. For example, by venting additional gas pressure before extraction, expansion of the spent cartridge casing is reduced facilitating extraction and reducing the extraction loading. The load and forces exerted on bolt 102, barrel extension 28, and upper receiver portion 70 are reduced. Thus, rather than having excess energy from the gas pressure consumed in the recoil cycle, more energy is directed for use in the counter recoil cycle and feeding and chambering of cartridges. The increased stroke length thus increases overall system operability, reliability and the life of the firearm. Operating performance with attachments that affect the gas operation of the rifle are also improved. For example, silencers accumulate gas to muffle the noise. The additional dwell time allows more gas to vent to the breech, reducing load on the barrel and providing longer barrel life when silencers are employed.

While the invention has been illustrated and described in detail in the drawings and foregoing description, the same is to be considered as illustrative and not restrictive in character. All changes and modifications that come within the spirit of the invention are desired to be protected.

What is claimed is:

1. A firearm assembly comprising:

an upper receiver including a barrel receiving portion and a longitudinal bore extending therethrough in communication with said barrel receiving portion;

a bolt carrier movably positioned in said longitudinal bore of said upper receiver;

a barrel assembly received in said barrel receiving portion; and a contiguous upper rail extending forwardly from and integrally formed with said upper receiver, wherein said contiguous upper rail extends over said barrel assembly in a floating relationship therewith, wherein said contiguous upper rail extends along said upper receiver and wherein the firearm assembly is configured and arranges so that said barrel assembly is insertable and removable from said upper receiver while said contiguous upper rail is integrally formed with said upper receiver.

2. The firearm assembly of claim 1, wherein said bolt carrier includes a modified cam path that includes an increased unlock dwell time of approximately twice the unlock dwell time provided by a standard M16 bolt carrier.

3. The firearm assembly of claim 2, wherein said modified cam path is lengthened approximately 0.100 of an inch toward a forward end of said bolt carrier as compared to the standard M16 bolt carrier.

4. The firearm assembly of claim 3, further comprising a protrusion at a forward end of said bolt carrier, wherein a first inner diameter of a bolt receiving portion of said bolt carrier is substantially equal to a second inner diameter of the protrusion.

5. The firearm assembly of claim 2, further comprising a protrusion at a forward end of said bolt carrier, wherein a first inner diameter of a bolt receiving portion of said bolt carrier is substantially equal to a second inner diameter of the protrusion.

6. The firearm assembly of claim 5, wherein said protrusion is sized to extend forwardly approximately 0.100 of an inch.

7. The firearm assembly of claim 2, wherein said bolt carrier includes a forward end portion and a rearward end portion, said forward end portion including a number of lands extending therealong and spaced thereabout for contacting said upper receiver portion in said bore, said number of lands occupying from about 1% to about 12% of a surface area of said forward end portion along which said number lands extend.

8. The firearm assembly of claim 1, wherein said upper receiver and said contiguous upper rail are integrally unitarily constructed.

9. The firearm assembly of claim 1, further comprising a guard portion integrally formed with said contiguous upper rail, wherein said guard portion extends along a portion of said barrel assembly in a floating relationship therewith.

10. The firearm assembly of claim 9, further comprising a plurality of mounting rails extending along said guard portion separated by recessed portions therebetween.

11. The firearm assembly of claim 8, further comprising a coupling portion integrally formed with and forward of said upper receiver portion, said coupling portion including a longitudinal slot separating said coupling portion into first and second clamping portions on respective sides of said slot, and a fastener positioned through said coupling portion transversely to said longitudinal slot, wherein said first and second clamping portions are constructed and arranged such that said fastener is operable to bring said first and second clamping portions toward one another to clamp said barrel assembly in said coupling portion.

12. The firearm assembly of claim 11, wherein said fastener is positionable in a recess in an outer surface of said barrel assembly to resist forward movement of said barrel assembly.

13. The firearm assembly of claim 11, wherein said contiguous upper rail extends forward of said coupling portion.

14. The firearm assembly of claim 1 further comprising:

a coupling portion integrally formed with and forward of said upper receiver portion, said coupling portion including a longitudinal slot separating said coupling portion into first and second clamping portions on respective sides of said slot; and a fastener positioned through said recess and said coupling portion transversely to said longitudinal slot, wherein said first and second clamping portions are constructed and arranged such that said fastener is operable to bring said first and second clamping portions toward one another to clamp said barrel assembly in said coupling portion and wherein said fastener resists forward movement of said barrel assembly with respect to said upper receiver.

15. The firearm assembly of claim 14, further comprising a recess in an outer surface of said barrel assembly, wherein said recess, said coupling portion and said fastener are constructed and arranged so that said fastener can resist any forward movement of said barrel assembly with respect to said upper receiver created by contact of said bolt carrier therewith.

16. The firearm assembly of claim 14, wherein said first and second coupling portions are constructed and arranged to clamp a substantially smooth portion of the barrel assembly.

17. The firearm assembly of claim 14, wherein the firearm assembly is part of a rotating bolt type firearm.

18. The firearm assembly of claim 14, wherein said upper receiver is constructed and arranged to receive an M16 lower receiver.

19. The firearm assembly of claim 1, wherein said upper receiver is constructed and arranged to receive an M16 lower receiver.

20. The firearm assembly of claim 1, wherein said contiguous upper rail extends forward of said barrel receiving portion.

* * * * *

UNITED STATES PATENT AND TRADEMARK OFFICE

CERTIFICATE OF CORRECTION

PATENT NO. : 8,561,337 B2
APPLICATION NO. : 12/872065
DATED : October 22, 2013
INVENTOR(S) : Karl R. Lewis It is certified that error appears in the above-identified patent and that said Letters Patent is hereby corrected as shown below:

Title page, item (62), replace "Division of application No. 10/513,254, filed as application No. PCT/US03/15009 on May 12, 2003, now Pat No. 8234,808" with --Division of U.S. Application, Serial No. 10/513,254, filed August 11, 2005 now U.S. Patent No. 8,234,808, which is a national stage of International Application No. PCT/US03/15009, filed May 12, 2003--.

Signed and Sealed this
Thirty-first Day of December, 2013

Margaret A. Focarino

Margaret A. Focarino
*Commissioner for Patents of the United States Patent and Trademark Office*